US006966102B2

(12) United States Patent
Shiue

(10) Patent No.: US 6,966,102 B2
(45) Date of Patent: Nov. 22, 2005

(54) BELTED ADJUSTER

(75) Inventor: Chih-Cheng Shiue, Rancho Santa Fe, CA (US)

(73) Assignee: QDS Injection Molding LLC, Rancho Sante Fe, CA (US)

( * ) Notice: Subject to any disclaimer, the term of this patent is extended or adjusted under 35 U.S.C. 154(b) by 33 days.

(21) Appl. No.: 10/737,848

(22) Filed: Dec. 18, 2003

(65) Prior Publication Data

US 2005/0050692 A1 Mar. 10, 2005

(51) Int. Cl.[7] ..... A44B 11/10
(52) U.S. Cl. ..... 24/196; 24/171; 24/194
(58) Field of Search ..... 24/16 PB, 171, 24/30.5 R, 265 BC, 194–197, 712.1, 712.5

(56) References Cited

U.S. PATENT DOCUMENTS 4,336,636 A * 6/1982 Ishiguro et al. ..... 24/115 M
4,912,814 A * 4/1990 McKenzie ..... 24/115 H
5,008,981 A * 4/1991 Smithson ..... 24/66.9
5,097,573 A * 3/1992 Gimeno ..... 24/712.6
5,365,641 A * 11/1994 Watanabe et al. ..... 24/115 G
6,446,272 B1 * 9/2002 Lee ..... 2/428
6,510,627 B1 * 1/2003 Liu ..... 36/50.1
6,859,947 B2 * 3/2005 Lee ..... 24/196

* cited by examiner

*Primary Examiner*—Robert J. Sandy
*Assistant Examiner*—Ruth C. Rodriguez
(74) *Attorney, Agent, or Firm*—Troxell Law Office, PLLC

(57) ABSTRACT

A belt adjuster, the belt adjuster includes a base, holes used for penetrating the belt are located in both sides; an adjustable support, a snap two slippers and a spring are interacted each other, the slippers controls the fastening of belt by means of pressing the snap; a top, which connects the adjustable support, the snap and the slipper are steadily located within the adjustable support, and the pressing area of the snap is projected in outside the top, the belt passes through the presetting holes, in order to that the belt is fastened.

8 Claims, 3 Drawing Sheets

BELTED ADJUSTER

FIELD OF THE INVENTION

The present invention relates to a belted adjuster, which is used for loosening or fastening straps attached to the belted adjuster. The belt adjuster and it's straps are used in various water sports equipment, including but not limited to diving masks, swimming goggles, bathing goggles and flippers etc.

BACKGROUND OF THE INVENTION

Straps are necessary component parts of diving masks used for both swimming or diving. These straps are used mainly to fasten the diving mask to the user's face, thus preventing water from entering the mask.

The tightness of strap determines whether or not: water enters the inside portion of the diving mask, the diving mask shifts in position or falls off easily during movement, and or the user's comfort level. With the straps set too loosely, the mask is likely to leak water, and shift positions or fall off easily. While, when the straps are set too tight, the user is likely to feel uncomfortable.

There are currently, many different types of head-wear, ranging from headbands, helmets, all the way to diving and swimming goggles. However, the most important requirement of all the differing head-wears is that it must be adaptable to the varying head sizes of different users. The head-wear must also be able to accommodate for the user's aesthetic feel, and fulfill the function for which it was bought.

For example, the traditional diving mask, it's strap adjusters are located in both sides of the diving mask. In order for the user to adjust the tightness of the strap the user needs to adjust the strap on one side at a time. However, by adjusting the mask from one side at a time, the original placement is lost, thus making optimal adjustment much harder to achieve. The added volume created by the traditional 2 side adjustment buckles also presents itself as an additional drawback. With a greater volume, the user will have a lesser field of vision, and be more troubled with the diving mask's size. With the best adjuster however, the user is able to adjust both sides of the mask at one time, thus allowing easier optimal fitting. The mask is also allowed to have lesser volume, which is another benefit towards the user.

SUMMARY OF THE INVENTION

The object of the present invention is to overcome above-mentioned problems in prior art and to provide a belted adjuster with simplified a constitution and ease in operation.

The technical solution adopted to resolve the problems is described as below: the belted adjuster includes a base having a bottom provided with an adjustable support, and two holes are located on both sides of said bottom; an adjustable support located on the base has a body, and holes are located on both sides of the body, inside of holes is provided with slippers, a spring is located between said two slippers, a snap making said slippers controlled is located above said body; an interactive structure is formed between said slippers and the under of said snap; a top covers over said adjustable support, holes are located on its both sides and a hole for protruding said snap is located at its middle; and two belts pass separately through the holes on said base, said adjustable support and said top, in order to stretch; an adjustable structure of tightness between belts and belted article is formed by means of pressing snap and stretching belts.

Wherein said base is penetrated by a base hole, wing holes are respectively located on the wings and via a base bolt connected.

Wherein said base is integrated with the adjustable support.

Wherein each side of said snap is provided with a unilateral open notch, and corresponding projections exist on said top.

Wherein some foot-shaped bodies with slope are located under said snap, and corresponding slopes exist on said slippers.

Wherein a structure for pressing the belts exists on said slippers.

Wherein a structure for seizing the ratchet-shaped projection of said belt exists on said slippers.

Wherein said two belts can be connected into one single belt.

The belted adjuster, which is the present invention, can be effectively utilized at the back of head, and the phenomenon of an enlarged volume, which created when strap tightness needs to be adjusted from both sides, can be eliminated. Further benefits with the utilization of the belted adjuster include: the additionally space available for creative designs on the diving mask or goggles, etc.; and the ease at which the user can tighten the fit by gently pulling the straps, or loosening by simply pressing a button. The present invention can be applied, included, but not limited to diving masks, goggles, flippers and headlights etc., and its operation is simple.

DETAILED DESCRIPTION OF PREFERRED EMBODIMENTS

Figure 1:
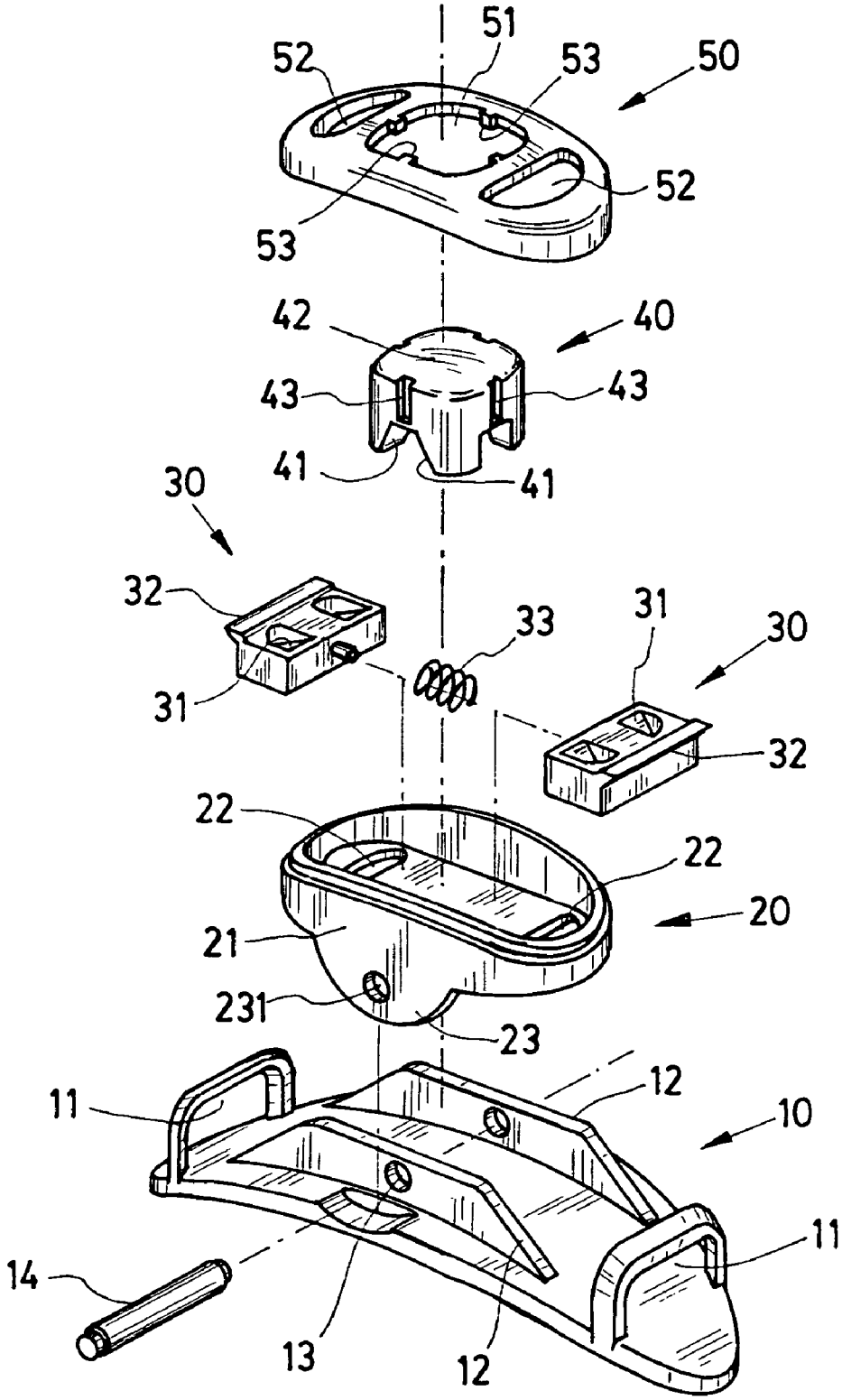
FIG. 1 is an exploded view of the belted adjuster for present invention.
Figure 2:
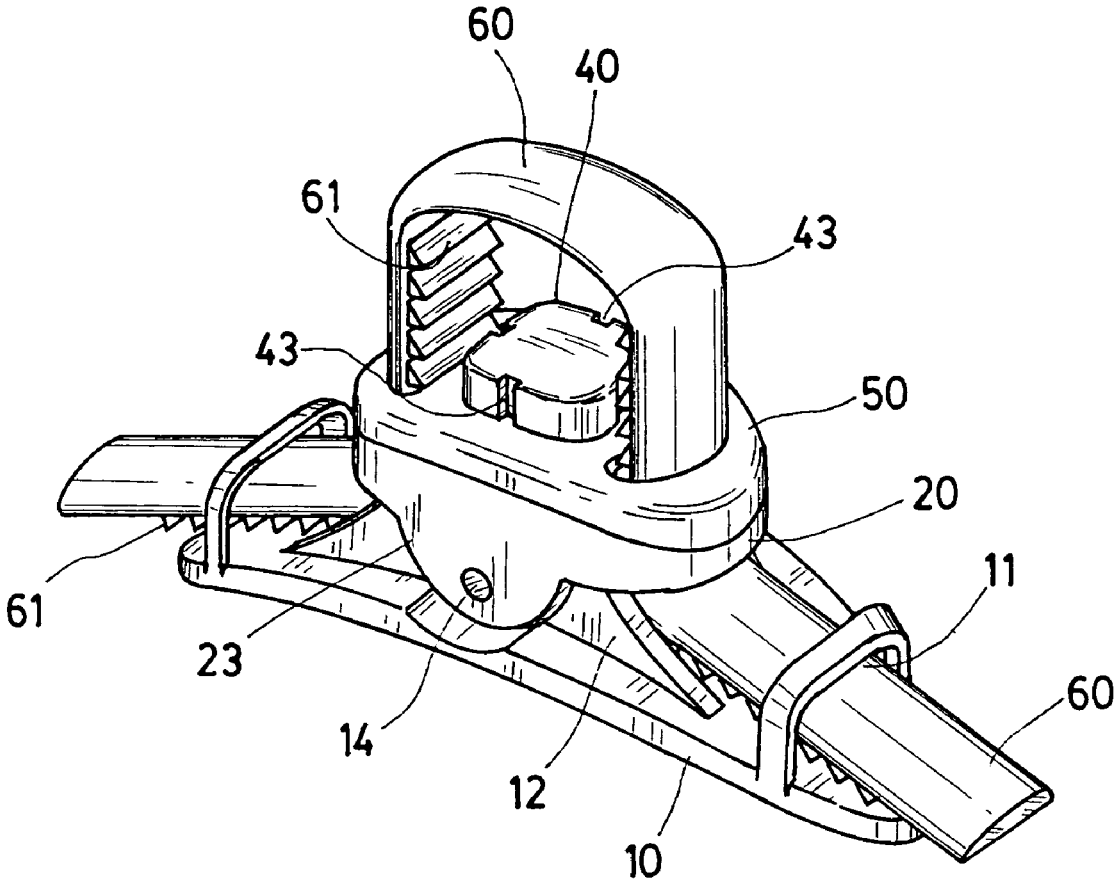
FIG. 2 is a perspective view of the belted adjuster for present invention.

Referring to FIG. 1 and FIG. 2, the belted adjuster includes mainly a base 10, an adjustable support 20, two slippers 30, a snap 40, a top 50 and belts 60 etc.

The base 10 is located in the back of user's head, its bottom surface, i.e. the surface fitting against head during the belts are dressed and with arc is preferred, its material can be made of some soft and tough materials, the adjustable support 20 is located above the base 10, a positioning hole 11 is located above the base 10 in each of both sides, two opposite axial holes 13 are located at the middle of two projections 12 and a base bolt 14 is passed through there.

The adjustable support 20 is a box-like structure, two slippers 30 are located above there, and the belt 60 can be passed through there; the adjustable support 20 includes a body 21, and two holes 22 are located on the both sides of the body 21; two vertical wings 23 are located on the both sides of the adjustable support 20, and a hole 231 corresponding to said axial hole 13 is located on each of both wings 23; the body 21 is connected on the base 10 by means of the base bolt 14 passing through the axial holes 13 and the holes 231.

The slipper 30 is member located within the body 21 and has two blocks opposed each other, whether the belt 60 is fastened, which can be controlled by operating the snap 40; the constitution of the slipper 30 has slop 31 and fastening flange 32; the slipper 30 can be moved by the slop 31 used for operating the snap 40 on a presetting path; the fastening flange 32 is used for pressing the belt 60, the belt 60 can not be returned in a loose state during the flange 32 presses the belt 60.

The spring 33 or related member is located between two slippers 30 opposed each other.

The snap 40 is a foot-shaped body with several slopes 41 and a pressing area 42, the outside of the snap 40 is provided with several unilateral open notches 43; the movement of slippers 30 can be via snap 40 controlled by means of the interaction between the slope 41 of snap 40 and the slope 31 of slippers 30; the notch 43 is fitted with the projection 53 of top 50.

The top 50 is integrated with the adjustable support 20, the constitution of the top 50 includes a hole 51 located about middle, two holes 52 in both sides of the hole 51. The hole 51 is used for locating the snap 40 upwardly, several projections 53 are located in the positions of the hole 51, where the corresponding notches 43 are located, the projections 53 are just located within the notches 43, the snap 40 will be downward steadily moved through the projections 53 during pressing the snap 40, the projections 53 are fastened on the end of the unilateral open notches 43 during the snap 40 moves upwardly to a presetting position, a positioning is then formed.

There are several ratchet-shaped projections 61 on the belt 60, these projections 61 with the flange 32 of the slippers 30 can be at least a constitution in the form of one-way fastening; the belt 60 can also be other constituent style, and can form fastening object with the slippers 30.

The belt 60 can be penetrated from the hole 11, passes upwardly then through the hole 22 of the adjustable support 20 from the middle of two projections 12, and passes upwardly again through the hole 52 of the top 50; the penetrated belt can be pulled. Above-mentioned belt 60 can be a constitution with double-strip or single-strip connected at the end.

Figure 3:
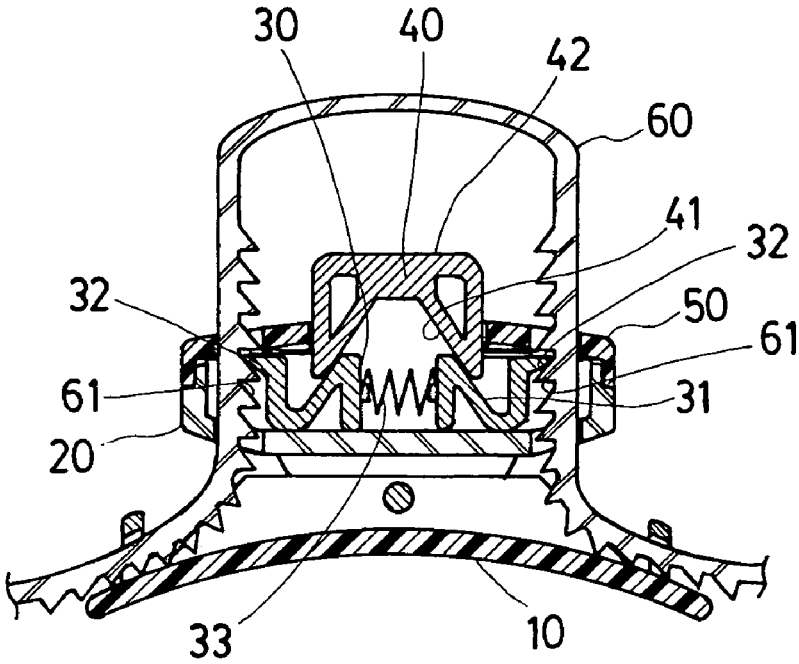
FIG. 3 is a longitudinal sectional view of the belted adjuster for present invention during the snap is not pressed down.

Referring to FIG. 3 during the snap 40 is not pressed, the spring 33 makes two slippers 30 trended to pull outward, the flange 32 of slipper 30 is then in a position between ratchet-shaped projections 61 of the belt 60, the belt 60 can not be moved downwards and is in loose state, i.e. the belt 60 keeps in a adjusted fastened state; since two slippers 30 are pulled outwardly, the slope 31 of the slippers 30 makes the slope 41 of snap 40 trended upwards.

Figure 4:
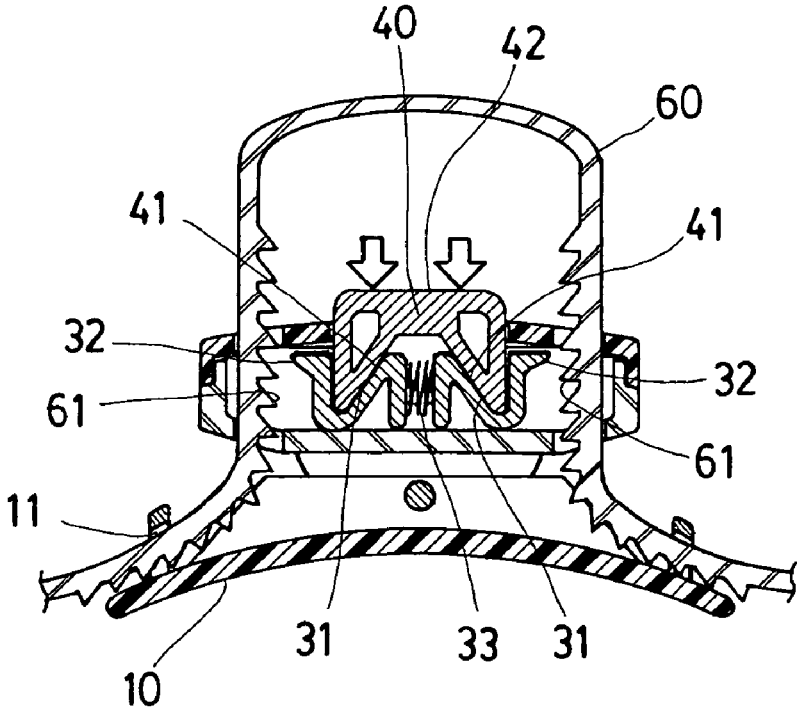
FIG. 4 is a longitudinal sectional view of the belted adjuster for present invention during the snap is pressed down.

Referring to FIG. 4 during the snap 40 is pressed, the slope 41 of snap 40 presses the slope 31 of slippers 30, which makes two slippers 30 trended to move inwards, at this time, the spring 33 is compressed, the flange 32 of slippers 30 is broken away from the middle of ratchet-shaped projections 61 of belt 60, which makes the belt 60 trended downwards, at this time, the operation fastening the belt 60 can be made in order to adjust the tightness of belt. The restoring force of spring 33 makes two slippers 30 moved outwardly, when the pressure pressing snap 40 is released, the slope 31 of sippers 30 presses the slope 41, which makes the snap 40 moved upwards and returned to the state shown in FIG. 3.

In other words, when it's to be desired that the belt 60 is fastened to the head, one can press the snap 40 with its finger, and pull the belt 60 to a desired tightness with another hand, at this time, pressing snap 40 is loosed, the snap 40 will be risen, since its slope 41 is pressed, the flange 32 of slipper 30 is in the middle of ratchet-shaped projections 61 of belt 60, the belt 60 is automatically fastened in state at that time.

The adjustable support 20 is a structure located on the base 10, its constitution does not limit above-mentioned structure, its base 10 can be mainly adapted to the change of head shape, and the adjustable support 20 is used for executing the function of adjust; both can even be constituted by a single member directly.

Said belt 60 with said slipper 30 executes corresponding actions each other, i.e. whether the belt 60 is pressed by the slipper 30 and the action of locking belt or fastening belt is formed, and its structure between both members does not limit said embodiment.

Therefore, the present invention can be effectively utilized at the back of head, and the phenomenon of an enlarged volume, which created when strap tightness needs to be adjusted from both sides, can be eliminated. Utilization of the belted adjuster allows for additionally space available for creative designs on the diving mask or goggles, etc. The breakthrough benefit offered by the use of the belted adjuster is the ease at which the user can tighten the fit by gently pulling the straps, or loosening by simply pressing a button. The present invention can be applied, included, but not limited to diving masks, goggles, flippers and headlights etc., and its operation is simple. The belted adjuster can therefore be seen as creating a new field of adjusters.

The disclosed content of the present invention is one of the preferred embodiments, all those local modifications or decorations which originate from the technical idea of the present invention, and area easily inducted by those skilled, still belongs to scope of the present invention.

What is claimed is:

1. A belted adjuster, characterized in that the belted adjuster includes a base having a bottom provided with an adjustable support, and two holes are located on both sides of said bottom;

the adjustable support located on the base has a body, and holes are located on both sides of the body, inside of each said hole is provided with a slipper, a spring is located between said two slippers, a snap controlling said slippers is located above said body; such that an interactive structure is formed between said slippers and under said snap;

a top covers over said adjustable support, holes are located on both sides of said top and a hole through which the snap protrudes is located at the middle of said top; and two belts pass separately through the holes on said base, said adjustable support and said top in order to stretch;

an adjustable structure of tightness between the belts and belted article is formed by means of pressing the snap and stretching the belts.

2. The belted adjuster according to claim 1, characterized in that said base is penetrated by a base hole, wing holes are respectively located on wings of the adjustable structure and connected to the base hole via a base bolt.

3. The belted adjuster according to claim 1, characterized in that said base is integrated with the adjustable support.

4. The belted adjustable according to claim 1, characterized in that each side of said snap is provided with an unilateral open notch, and corresponding projections exist on said top.

5. The belted adjustable according to claim 1, characterized in that some foot-shaped bodies with slope are located under said snap, and corresponding slopes exist on said slippers.

6. The belted adjustable according to claim 1, characterized in that a structure for pressing the belts exists on said slippers.

7. The belted adjustable according to claim 1, characterized in that a structure for seizing a ratchet-shaped projection of said belt exists on said slippers.

8. The belted adjustable according to claim 1, characterized in that said two belts can be connected into one single belt.

* * * * *